US010618142B2

(12) United States Patent
Kovacs

(10) Patent No.: US 10,618,142 B2
(45) Date of Patent: Apr. 14, 2020

(54) TWO PIECE SPINDLE FIXTURE

(71) Applicant: Lajos Kovacs, Bensenville, IL (US)

(72) Inventor: Lajos Kovacs, Bensenville, IL (US)

( * ) Notice: Subject to any disclaimer, the term of this patent is extended or adjusted under 35 U.S.C. 154(b) by 0 days.

(21) Appl. No.: 15/972,474

(22) Filed: May 7, 2018

(65) Prior Publication Data

US 2019/0337118 A1 Nov. 7, 2019

(51) Int. Cl.

| | |
|---|---|
| ***B24B 41/04*** | (2006.01) |
| ***B24B 47/12*** | (2006.01) |
| ***B24B 41/02*** | (2006.01) |
| ***B24B 53/14*** | (2006.01) |
| *B24B 41/06* | (2012.01) |

(52) U.S. Cl.

CPC ..... *B24B 41/042* (2013.01); *B24B 41/02* (2013.01); *B24B 47/12* (2013.01); *B24B 53/14* (2013.01); *B24B 41/06* (2013.01)

(58) Field of Classification Search

CPC ..... B24B 41/042; B24B 41/02; B24B 47/12; B24B 53/14; B24B 41/06

See application file for complete search history.

(56) References Cited

U.S. PATENT DOCUMENTS

| | | | | |
|---|---|---|---|---|
| 2,406,467 A * | 8/1946 | Looney | B24B 41/06 | 125/11.14 |
| 2,480,618 A * | 8/1949 | Tresidder | B23Q 1/48 | 269/61 |
| 4,100,702 A * | 7/1978 | Zapart | B24B 41/06 | 33/569 |
| 4,306,384 A * | 12/1981 | Hyz | B24B 41/06 | 451/365 |
| 4,498,260 A * | 2/1985 | Doty | B24B 41/06 | 451/365 |
| 2003/0083004 A1* | 5/2003 | Caporusso | B24B 9/007 | 451/296 |

* cited by examiner

*Primary Examiner* — David H Bollinger
(74) *Attorney, Agent, or Firm* — James D Palmatier; Applied Patent Services, PC

(57) ABSTRACT

The two piece spindle grinder fixture is adapted to minimize the size of the frame by a two piece spindle assembled into a frame having a bearing race formed between the frame and the two piece spindle. An angularity adjustable angle indicator mounted concentric with a spindle axis to allow the indicator to be adjusted relative to a part attached to the two piece spindle, A chuck or other holding tool may be mounted on the chuck end of the two piece spindle opposite a handle on a handle end.

13 Claims, 2 Drawing Sheets

TWO PIECE SPINDLE FIXTURE

FIELD OF THE INVENTION

The present invention relates generally to a tow piece spindle grinder fixture adapted to hold a part for grinding.

BACKGROUND OF THE INVENTION

A work holder adapted to be secured to a work bed of a grinding machine etc., with an indexing workpiece holder adapted to hold a workpiece in a predetermined orientation relative to a machine tool such as a grinder. A base for mounting a fixture relative to the bed of the machine. A housing is pivotally mounted 'on the base with means for releasably locking the housing in any one of a plurality of angular positions relative to the 'base. A chuck end extending longitudinally from the frame front and a handle end extending from the frame on the back side. The two piece spindle having a locking ring provided with circular row of equi-spaced axial openings adapted to receive a locking pin to hold the Two Piece spindle in a predetermined orientation. The two piece spindle rotatable relative to the frame. A retainer pin having a spring-loaded orientation for radial extension to seat within one of the openings in the locking ring.

The inventor has come to realize from his experience that the size of the work-piece is limited by the spindle aperture size on the grinding fixture. The spindle size is relative to the size of the base supporting the spindle. Therefore in the prior art large work-pieces required a large fixture. The two piece spindle grinder fixture is a novel part holding invention having a two piece spindle mounted on a base adapted to hold a part in a predetermined orientation. The part may be a work-piece or tool depending on the application. The two piece spindle grinder fixture reduces the base size required to hold relatively larger parts.

SUMMARY OF THE INVENTION

A primary object of the two piece spindle grinder fixture is to provide a fixture adapted to hold a relatively large part while reducing the size of the frame.

Another object of the two piece spindle grinder fixture is to provide an adjustable angle indicator on the fixture to adapt the measurement to the orientation of the part.

Another object hereof is to improve upon prior art indexing work-piece or tool holding devices of this type by reducing the number of component parts and the overall size, specifically forming the bearing using the frame and two piece spindle as a bearing race.

Another object of the invention is to maximize the spindle aperture size relative to the frame size.

Another object of the two piece spindle grinder fixture is to allow the use of standard chucks and work-piece holders and ball bearings for utilization in the rotary or fixed grinding of shapes such as tapers, simple and compound angles, cam lobes and forms, and the like.

The two piece spindle grinder fixture may comprise a two piece spindle having a front portion and a back portion joined together concentrically within a frame aperture in a frame. The frame may have a bearing V-groove formed in the frame aperture wall. The frame may have a front shoulder between the V-groove and the front and a back shoulder between the V-groove and the back. The front and back shoulder assist in assembly and limit travel through the frame aperture. The frame aperture having a inner wall concentric about an axis with a stepped interior formed by the front shoulder and back shoulder. Each of the front portion and the back portion may have an frame end. Each of the front portion and back portion may have a complementary bearing surface on their respective frame end. When assembled having the frame ends may be disposed in the frame aperture having the bearing V-groove, front portion bearing surface and back portion bearing surface form a bearing race with the V-groove forming the outer race and the front portion bearing surface joined to the back portion bearing surface forming the inner race. Bearings in the race provide a reduced friction interface between spindle and the frame.

The front portion may have a front body, the front body comprises a front chuck end, a front frame end and an open front spindle interior, the open front spindle interior extending from the front chuck end to the front frame end, Likewise, the back portion may have a back body comprising a back handle end, a back frame end and a back spindle interior, the back spindle interior extending from the back handle end to the back frame end.

The front spindle portion attaches to the back spindle portion having the front spindle interior concentric with the back spindle interior forming the two piece spindle. A chuck or fixture clamp may he disposed on chuck end. A handle may be attached to the handle end. Pressure on the handle urges the twop piece spindle to rotate in the frame aperture about the axis to position a part in the chuck to a desired position for interface with a grinder, or other processing device for grinding of tapers, simple and compound angles, cam lobes and forms, and the like.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. (It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting.

Figure 2:
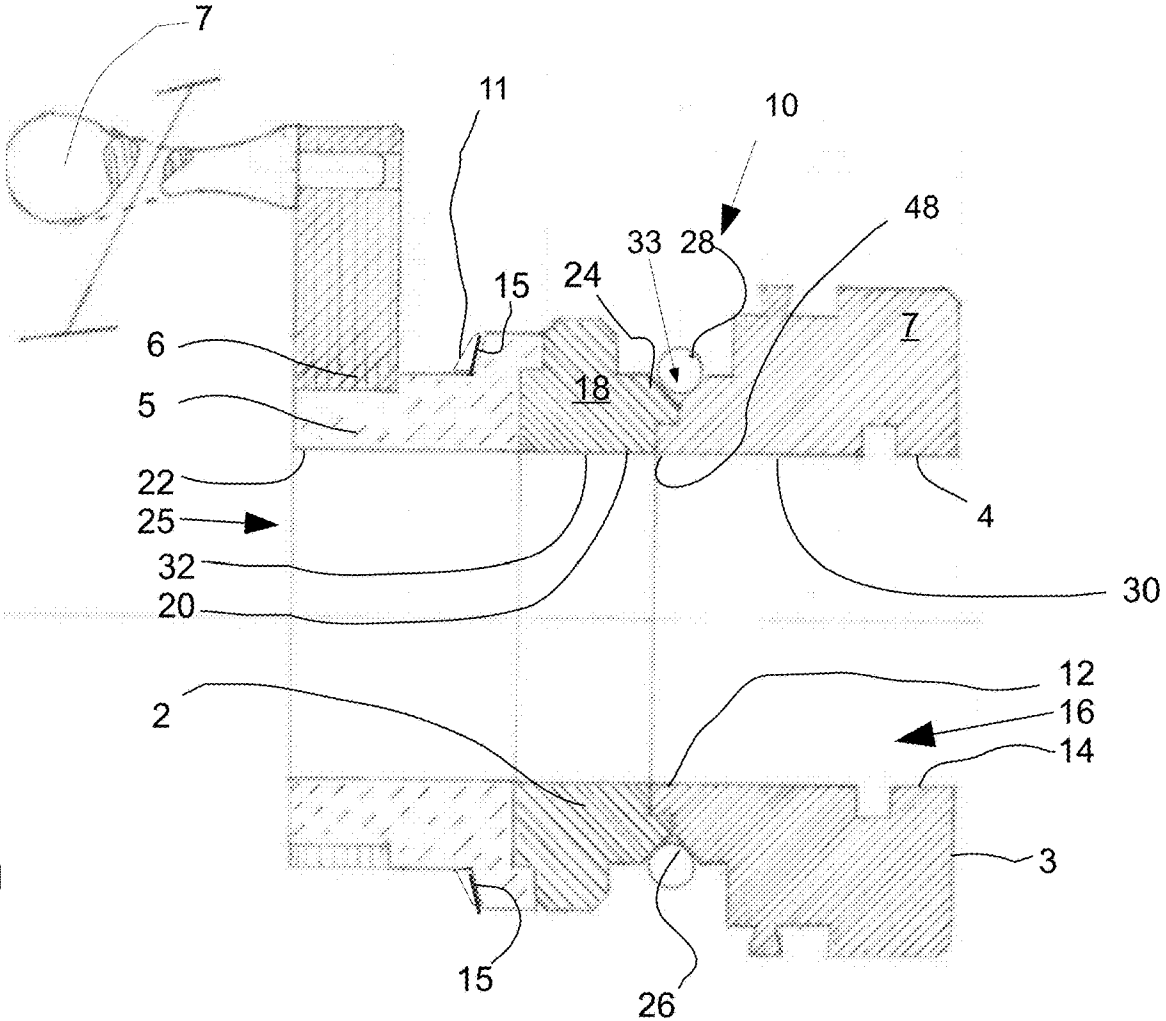
FIG. 2 is a cut away of the two piece spindle of FIG. 1 taken at approximately 2-2 of FIG. 1.
Figure 1:
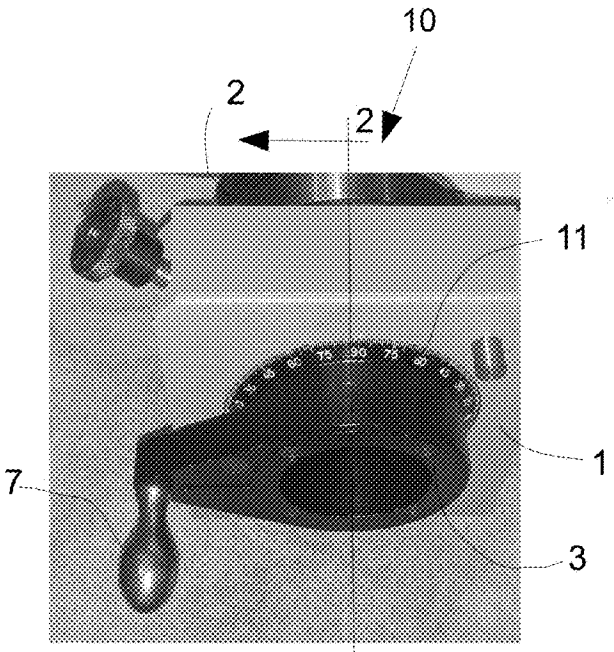
FIG. 1 is a perspective view of the invention.

Referring to FIGS. 1 and 2, the improved two piece spindle 10 may be mounted in a frame 1. The two piece spindle 10 comprising a back spindle portion 2 and a front spindle portion 3. The front spindle portion 3 comprises a front body 7 having a front frame end 12, a front chuck end 14 and a front spindle aperture 16. The front spindle aperture 16 extends from the front frame end 12 to the front chuck end 14. A part holder 4 on the front chuck end 14. A front bearing surface 26 formed on the front frame end 12. The back spindle portion 2 comprises a back body 18 having a back frame end 20, a back handle end 22 and a back spindle aperture 25. The back spindle aperture 25 extends from the back frame end 20 to the back handle end 22. A back bearing surface 26 formed on the back frame end 20.

Continuing to refer to FIGS. 1 and 2, a plurality of bearings 28 may be disposed in the v-channel 33 formed by front bearing surface 26 and back bearing surface 28. A handle ring 5 extends from back handle end 6 and a handle 7 may be on the back spindle portion 2. An adjustable angle indicator 11 is mounted on two piece spindle adjacent frame 1. Adjustable angle indicator 11 may be attached by a releasable resilient fixer 15. Fixer 15 is attached to two piece spindle 10. Fixer 15 may be a releasable resilient attachment. The front spindle aperture 16 may have a front spindle surface 30. Back spindle aperture 25 may have a back spindle surface 32 disposed concentric with front spindle surface 30 forming a two piece spindle aperture 48. Angular indexing mechanism 60 may comprise spring loaded pin 62 adapted to radially extend through frame 1 to engage indexing tabs 64 on two piece spindle 10.

Figure 3:
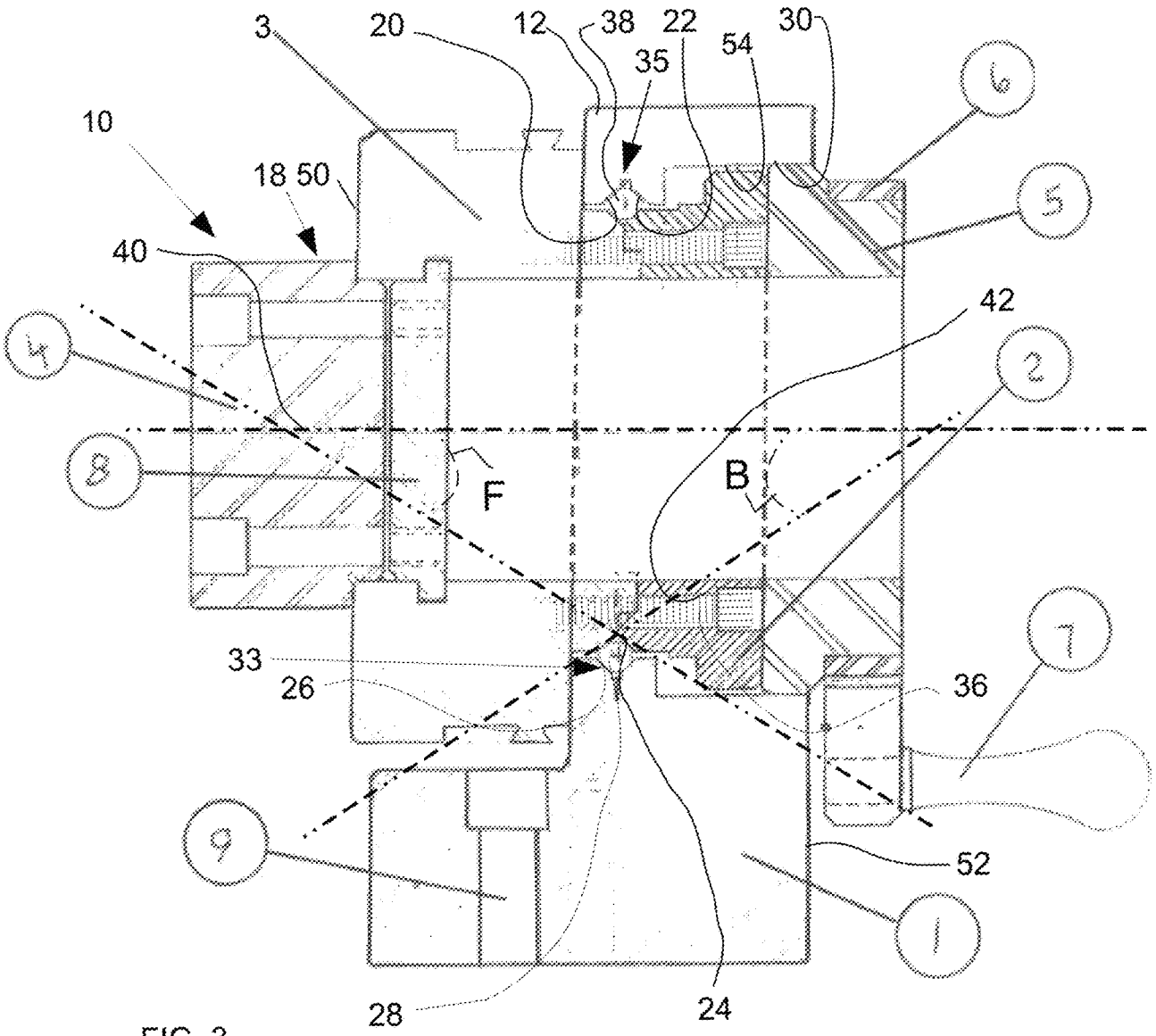
FIG. 3 is a cut away of the two piece spindle in the spindle housing of FIG. 1 taken at approximately 2-2 of FIG. 1.

Referring to FIG. 3, frame 1 comprises a base connector 9 for anchoring the frame 1. Frame 1 further comprises a frame aperture 31 extending from frame front 50 to frame back 52. Frame aperture 31 may have an axis 40 and frame aperture surface 54. Front spindle portion 3 is sized to fit concentrically in frame aperture 31, Front spindle portion 3 may be attached to back spindle portion 2 by bolt 36 disposed in hole 42 and threadably engaged to back spindle portion 2. Bolt 36 is adapted to bear against front spindle portion 3 to urge front spindle portion 3 to bear against back spindle portion 2. The front bearing surface 26 and back bearing surface 24 are each disposed at angle F and B respectively. Each of angles F and B are between 30 and 60 degrees toward the axis 40 to taper front frame end 12 and back frame end 20 respectively. Outer race 35 is formed in frame 10 in frame aperture 31 having a similar and reverse profile of spindle V-groove 33. Outer race 35 is disposed adjacent front bearing surface 26 and back bearing surface 24. Bearings 28 disposed in rectangular bearing race 38 are sized to provide a reduced friction interface between the frame 1 and the two piece spindle 10.The front frame end 14 is in the frame aperture 31. Back frame end 20 is in the frame aperture 31. Front frame end 14 is bearing against back frame end 20. Two piece spindle aperture 48 extending from front chuck end 4 to back handle end 22.

In use, a front portion 3 is placed on a flat surface having the axis of the aperture approximately vertical. The frame 1 is set on top of the front portion 3 having having outer race 35 adjacent front bearing surface 26. Bearings 28 may be disposed in outer race 35 and held by gravity as back portion 2 is inserted into the frame aperture and attached to front portion 3. Bearings 28 are retained in race 38.

Although the description above contains many specifications, these should not be construed as limiting the scope of the invention but as merely providing illustrations of some of the embodiments of this invention, Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. A two piece spindle grinding fixture comprising:

a frame, the frame having a front and a back, a frame aperture formed in the frame extending from the front to the back, the frame aperture having an aperture axis and an inside surface, an outer race in the inside surface, the outer race concentric with the aperture axis, the outer race disposed between the frame front and the frame back;

a two piece spindle comprising a front spindle portion and a back spindle portion, the front spindle portion comprising a hollow front body having a front frame end and a front chuck end, a front bearing surface on the the front frame end, the front frame end in the frame aperture, the front bearing surface adjacent the outer race, the back spindle portion comprising a hollow back body, the hollow back body comprising a back frame end and a back handle end, a handle attached to the back handle end, a back bearing surface on the back frame end, the back frame end in the frame aperture, the back bearing surface adjacent the outer race, the back spindle portion bearing against the front spindle portion whereby a closed bearing race is formed between the outer race, the front bearing surface and the back bearing surface; and a plurality of bearings in the closed bearing race, the bearings bearing against the two piece spindle and the frame.

2. The two piece spindle grinding fixture of claim 1, further comprising an angle indicator on the back spindle portion concentric about the aperture axis, the angle indicator adjustable about the aperture axis.

3. The two piece spindle grinding fixture of claim 2, further comprising a mark on the frame adjacent the angle indicator.

4. The two piece spindle grinding fixture of claim 3, wherein the angular indicator is between the handle and the compressible portion, whereby the angular indicator is adjustably rotatable about the aperture axis.

5. The two piece spindle grinding fixture of claim 1, wherein the front spindle portion is removably attached to the back spindle portion.

6. The two piece spindle grinding fixture of claim 5, wherein the front bearing surface further comprises a taper on the front frame end, the back bearing surface further comprises a taper on the back frame end.

7. The two piece spindle grinding fixture of claim 6, further comprising an angular indexing mechanism wherein the two piece spindle may be fixed in a predetermined angular orientation about the axis.

8. A two piece spindle grinding fixture comprising:

a frame comprising a body, the body having a front and a back, a frame aperture in the body, the frame aperture extending from the front to the back, the frame aperture having an axis and an inside surface, an outer race formed in the inside surface;

a two piece spindle in the spindle aperture, the two piece spindle comprising a front spindle portion, and a back spindle portion, the front spindle portion in the the frame aperture, the back spindle portion in the frame aperture, the front spindle portion attached to the back spindle portion. a spindle V-groove on the two piece spindle, the spindle V-groove adjacent the outer race; and a plurality of bearings disposed in the outer race, each of the plurality of bearings bearing against the two piece spindle whereby the two piece spindle is held in spaced relation to the inside surface and the twop piece spindle is retained in the frame.

9. The two piece spindle grinding fixture of claim 8, wherein the front spindle portion is removably connected to the back spindle portion.

10. The two piece spindle grinding fixture of claim 9, further comprising a rotationally adjustable angle indicator on the two piece spindle, a reference mark on the frame, the angle indicator adjacent to the reference mark.

11. The two piece spindle grinding fixture of claim 10, further comprising a fixer on the two piece spindle, the angle indicator attached to the fixer.

12. The two piece spindle grinding fixture of claim 8, wherein the spindle V-groove further comprises a front bearing surface on the front spindle portion and a back bearing surface on the back spindle portion, the front bearing surface disposed adjacent the back bearing surface.

13. A two piece spindle grinding fixture comprising a frame and a two piece spindle, the frame comprising a body having a front and a back, a frame aperture in the body, the frame aperture having an inside surface and an axis, the inside surface extending through the body from the back to the front, an outer race in the inside surface, the outer race concentric with the axis, the two piece spindle having a spindle aperture surrounded by a spindle body, the spindle body having an outside, an inner race on the outside, the two piece spindle in the frame aperture, the inner race disposed adjacent the outer race, a plurality of bearings in the outer race, the bearings bearing against the two piece spindle, the outside in spaced relation to the inside surface, a handle end on the two piece spindle, a chuck end on the two piece spindle, an angle indicator on the two piece spindle.

* * * * *